US009119440B2

(12) United States Patent
Lagneau et al.

(10) Patent No.: US 9,119,440 B2
(45) Date of Patent: Sep. 1, 2015

(54) INSOLE FOR A FOOTWEAR ARTICLE

(75) Inventors: Adrien Lagneau, Sars et Rosieres (FR); Jean-Marc Baudouin, Bousbecque (FR); Pierre Vincent, La Rochelle (FR); Mathias D'Estais, Caen (FR)

(73) Assignee: DECATHLON, Villenueve d'Ascq (FR)

( * ) Notice: Subject to any disclaimer, the term of this patent is extended or adjusted under 35 U.S.C. 154(b) by 343 days.

(21) Appl. No.: 13/641,007

(22) PCT Filed: Apr. 13, 2011

(86) PCT No.: PCT/FR2011/000215

§ 371 (c)(1),
(2), (4) Date: Dec. 19, 2012

(87) PCT Pub. No.: WO2011/128529

PCT Pub. Date: Oct. 20, 2011

(65) Prior Publication Data

US 2013/0091729 A1 Apr. 18, 2013

(30) Foreign Application Priority Data

Apr. 13, 2010 (FR) ..... 10 52785

(51) Int. Cl.
*A43B 7/06* (2006.01)
*A43B 13/40* (2006.01)
(Continued)

(52) U.S. Cl.
CPC . *A43B 13/40* (2013.01); *A43B 7/06* (2013.01); *A43B 7/087* (2013.01); *A43B 9/06* (2013.01); *A43B 13/20* (2013.01); *A43B 13/203* (2013.01)

(58) Field of Classification Search
CPC ..... A43B 7/06; A43B 7/08; A43B 7/081; A43B 7/082; A43B 7/084; A43B 7/087
USPC ..... 36/3 R, 3 A, 3 B, 29
See application file for complete search history.

(56) References Cited

U.S. PATENT DOCUMENTS 890,966 A * 6/1908 Critz, Jr. ..... 36/3 R
1,540,430 A * 6/1925 Sims ..... 36/3 B
(Continued)

FOREIGN PATENT DOCUMENTS

DE 529 106 C 7/1931
EP 1721536 A1 11/2006
(Continued)

OTHER PUBLICATIONS

International Search Report: mailed Feb. 8, 2011; PCT/FR2011/000215.

*Primary Examiner* — Marie Bays
(74) *Attorney, Agent, or Firm* — Ladas & Parry LLP

(57) ABSTRACT

The invention relates to an insole, and to an article of footwear provided with such an insole, with application to the design of shoes wherein an improvement in comfort is sought.
The insole includes a principal portion 1 designed to accommodate the pressure of a user's foot, comprising at least one deformable cavity 2, 5 filled with a compressible, fluid-permeable material 3, 6 and provided on the one hand with at least one inlet E1, E2 for fluid intake and on the other hand with at least one outlet S1, S2, S3 for exhausting the fluid. Further, the thickness of the principal portion, in the non-deformed state of the cavity, is substantially constant, with the possible exception of the perimeter of the cavity and/or the possible exception of the inlets and/or outlets.

26 Claims, 2 Drawing Sheets

Figure 1:
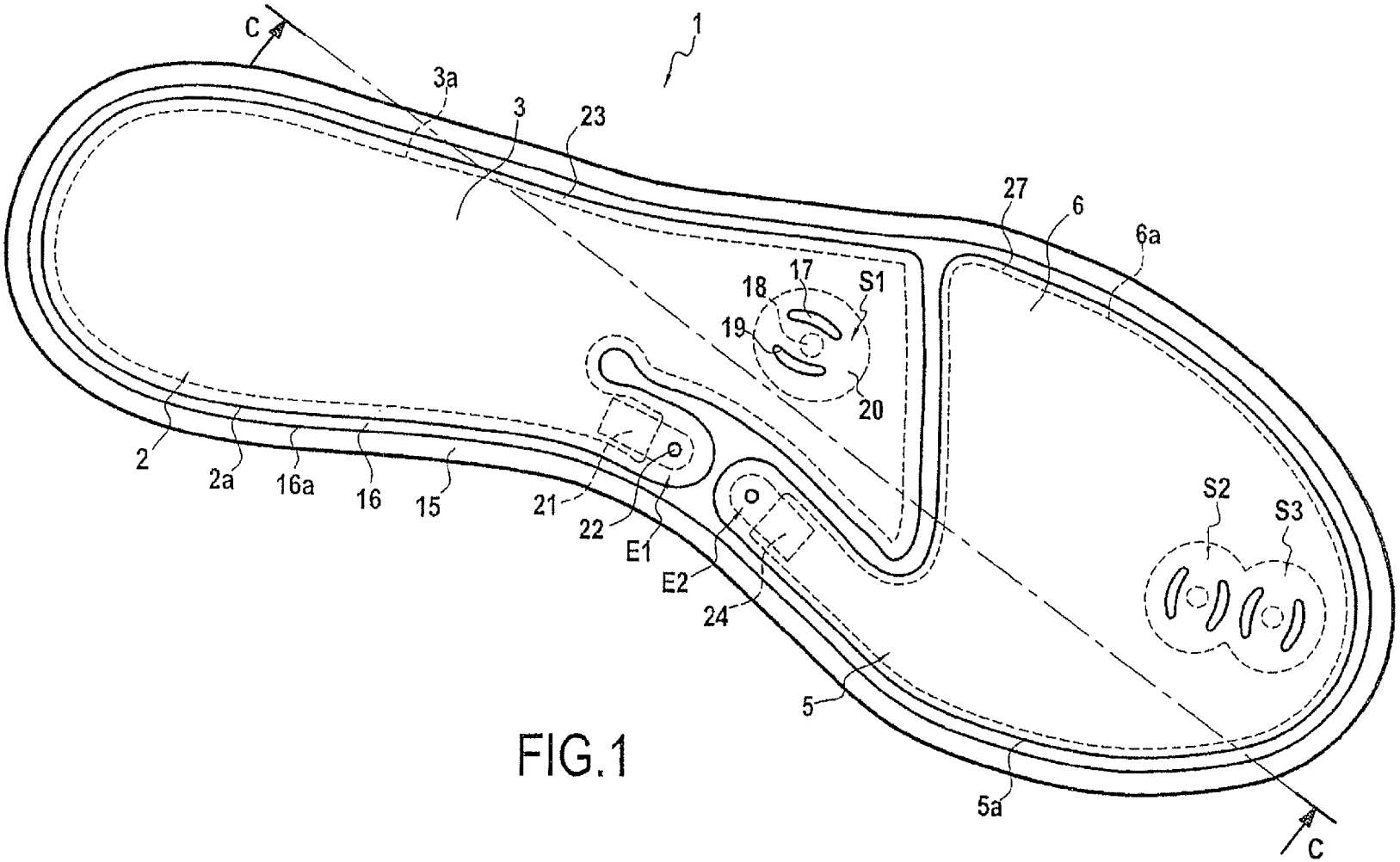

(51) Int. Cl.

| | |
|---|---|
| ***A43B 7/08*** | (2006.01) |
| ***A43B 9/06*** | (2006.01) |
| ***A43B 13/20*** | (2006.01) |

(56) References Cited

U.S. PATENT DOCUMENTS

| | | | | | |
|---|---|---|---|---|---|
| 2,604,707 | A | * | 7/1952 | Hicks | 36/3 R |
| 3,253,355 | A | * | 5/1966 | Menken | 36/29 |
| 3,475,836 | A | * | 11/1969 | Brahm | 36/3 R |
| 3,716,930 | A | | 2/1973 | Brahm | |
| 3,791,051 | A | * | 2/1974 | Kamimura | 36/44 |
| 4,123,855 | A | * | 11/1978 | Thedford | 36/44 |
| 4,336,661 | A | * | 6/1982 | Medrano | 36/44 |
| 4,590,689 | A | * | 5/1986 | Rosenberg | 36/3 B |
| 4,670,995 | A | * | 6/1987 | Huang | 36/29 |
| 4,835,883 | A | * | 6/1989 | Tetrault et al. | 36/3 R |
| 4,885,849 | A | * | 12/1989 | Lambert | 36/3 B |
| 5,606,806 | A | * | 3/1997 | O'Dwyer | 36/3 B |
| 6,014,823 | A | * | 1/2000 | Lakic | 36/93 |
| 6,453,577 | B1 | | 9/2002 | Litchfield et al. | |
| 6,510,624 | B1 | * | 1/2003 | Lakic | 36/29 |
| 7,409,779 | B2 | * | 8/2008 | Dojan et al. | 36/3 B |
| 2007/0094890 | A1 | | 5/2007 | Cho et al. | |
| 2008/0016715 | A1 | * | 1/2008 | Vickroy | 36/2.6 |

FOREIGN PATENT DOCUMENTS

| | | | |
|---|---|---|---|
| FR | 252086 | A1 | 10/1983 |
| JP | 62-266002 | A | 11/1987 |
| JP | 2-4409 | U | 1/1990 |
| JP | 2-143004 | U | 12/1990 |
| JP | 2010-054047 | A | 3/2010 |
| RU | 1799257 | C | 2/1993 |
| RU | 2321321 | C | 4/2008 |
| SU | 1600682 | A1 | 10/1990 |
| WO | 95/00047 | A1 | 1/1995 |

* cited by examiner

INSOLE FOR A FOOTWEAR ARTICLE

The invention has as its object an insole for footwear and footwear equipped with such an insole. The meaning of insole for footwear as used in this invention is an intermediate structure or intermediate sole, positioned between an outsole in particular, on the one hand, and an insole lining, on the other hand, inside a shoe.

The invention finds application particularly in the design of shoes wherein an improvement in comfort is sought, through the use of a fluid such as air constituting one or more air cushions.

Footwear is known having cavities wherein foam elements can be inserted, capable of accommodating air to constitute cushion type comfort and/or shock absorbing elements.

To guarantee comfort in use, it is necessary to allow the air to circulate from rear to front as the foot rocks during walking.

Such products are for example described in documents FR 2 525 086 and U.S. Pat. No. 3,716,930.

These documents thus describe complex systems for admitting and exhausting air as the foot rocks, through valves and intermediate cavities which communicate with one another.

The disadvantages of this type of configuration are the complexity of the fluid circulation circuit, lack of comfort and instability during walking motion.

This series of cavities, partly stacked, also requires hollowing out the sole wherein the insole will be accommodated and thus makes manufacture more complex and costly, and/or requires the user to tolerate uncomfortable excess thickness.

The object of the invention is therefore to provide a solution to the aforementioned problems and disadvantages, among others.

The invention thus relates, in a first aspect, to an insole for footwear, having a main portion designed to accommodate the pressure of a user's foot.

This main portion includes at least one deformable cavity filled at least partly with a compressible fluid-permeable material.

Said cavity is provided, on the one hand, with at least one inlet allowing fluid to be admitted into said cavity, and on the other hand with at least one outlet distinct from the inlet and allowing fluid to be exhausted from the cavity.

The thickness of the principal portion, in the undeformed state of the cavity, is substantially constant, with the possible exception of the perimeter of the cavity and/or the possible exception of the inlet and/or outlet.

Preferably, the cavity extends substantially over at least the rear portion of the principal portion.

Said cavity can then extend over substantially all the principal portion, or extend from the portion of the principal portion corresponding to the heel, substantially to at least the boundary of the area of the principal portion corresponding to the medio-plantar region.

The principal portion may possibly include, in addition to the cavity called the first cavity, a second deformable cavity, at least partially filled with a compressible, fluid-permeable material.

This second cavity is also provided, on the one hand, with at least one inlet allowing intake of fluid into this second cavity, and on the other hand with at least one outlet, distinct from the inlet and allowing fluid to be exhausted from the second cavity.

Preferably, the first and the second cavities do not communicate.

The second cavity can also extend substantially over at least the front portion of the principal portion.

Preferably, the second cavity extends from the portion of the principal portion corresponding to the toes, substantially to at least the boundary of the area of the principal portion corresponding to the media-plantar region.

Preferably too, the first and second cavities extend at least partly over the area of the principal portion corresponding to the medio-plantar region.

Other embodiments are presented hereafter, which can be considered alone or in combination with one or more others.

The distance between the inlet(s) of the cavity(ies) and the back end of the cavity(ies) is less than the distance between the outlet(s) of the cavity(ies) and said back end of the cavity (ies).

The principal portion exhibits an upper wall oriented toward the foot during use and a lower wall oriented to the side opposite the upper wall, and the inlets) include an opening formed in the lower wall.

Said inlet(s) are equipped with a non-return valve.

The outlet(s) include an opening formed in the upper wall.

The outlets include an opening and one or more channels bounded at least in part by one or more edges.

The insole includes a chimney connected with the inlet(s), that is an intake channel capable of carrying the fluid to the inlets.

The insole can also include an exhaust channel connected to the outlets, capable of exhausting and possibly directing the fluid away from the outlets.

The compressible material is of the foam type, a polyurethane for example.

The upper wall is assembled, for instance by heat-sealing, to the lower wall by one or more assembly lines forming the perimeter of the cavity(ies).

These upper and lower walls are made of flexible plastic, of the polyurethane film type for example.

The upper wall is covered with a layer of polyester type material for example, serving as an insole liner.

This layer is assembled to said upper wall by heat-sealing for example, and is equipped with one or more openings, preferably facing the inlet(s) and/or outlet(s).

This layer is equipped with several openings preferably distributed in a circle around the point facing the inlet(s) and/or outlet(s).

The upper and lower walls extend beyond the assembly line(s), so as to leave free a strip along the perimeter of the principal portion allowing assembly of said principal portion, by sewing for example, to the upper of an article of footwear.

The perimeter strip can be provided with a weld seam or line of coverstitching.

The cavity(ies) extend over a width of the principal portion, called the cavity width, which is such that the width of the user's footprint on the principal portion is greater than or equal to, preferably equal to, the width of the cavity.

The invention also relates, according to a second aspect, to an article of footwear equipped with an outsole and an insole such as that presented above and positioned above the outsole.

Preferably, the article of footwear includes an upper provided with a fluid inlet opening connected to the inlet(s).

This opening can be adjustable between an open position allowing intake of fluid and a closed position preventing intake of fluid.

In the case where the insole includes a chimney connected to the inlet(s), said chimney is positioned along the upper and connected to the opening.

Other features and advantages will appear completely and more clearly upon reading the following description of the preferred embodiments, which are given by way of non-limiting examples, and with reference to the appended drawings wherein:

FIG. 1: shows schematically an example of an insole according to the invention, viewed from below, FIG. 2: shows schematically the example of FIG. 1, viewed in section, FIG. 3: shows schematically the example of FIG. 1 in exploded view, FIG. 4: shows schematically an article of footwear equipped with an insole according to the invention, in exploded view.

An example embodiment of the insole according to the invention is shown schematically in FIG. 1, viewed from below.

In this example, the principal portion 1 of the insole is provided with two cavities 2 and 5 which do not communicate.

A first cavity 2 extends from the rear portion of the principal portion 1, that is the area corresponding to the heel, substantially up to the forward boundary of the area corresponding to the plantar arch. Its boundaries are embodied by the continuous line labeled 2*a*.

The second cavity 5, for its part, extends from the forward portion of the principal portion 1, that is the area corresponding to the toes, substantially up to the forward boundary of the area corresponding to the plantar arch. These boundaries are embodied in the continuous line labeled 5*a*.

The first cavity 2 includes an element 3 made of compressible material permeable to a fluid such as air, the edges whereof are shown by the dotted lines 3*a* and stop just before the boundary 2*a* of the first cavity 2, leaving a space 23 free.

The width of this free space 23 corresponds to a compromise between, on the one hand, the necessity of not placing the element 3 made of compressible and fluid-permeable material too near the edge 2*a* of the first cavity 2, which could harm the fluid-tightness of this first cavity 2 during assembly of the upper wall and the lower wall forming the principal portion 1 as will be seen later, and on the other hand the necessity of not leaving too great a space between this edge 2*a* of the first cavity 2 and the element 3, which could allow said element 3 to move within the cavity 2 and in that case to interfere with the stability of the user, and hence his comfort.

The second cavity 5 includes an element 6 made of compressible material permeable to a fluid such as air, the edges whereof are shown by dotted lines 6*a* and stop just before the boundary 5*a* of the second cavity 5, leaving a space 27 free.

The same considerations as those above relating to the free space 23 apply to the free space 27.

The elements 3 and 6 can be made of polyurethane type foam for example.

The first cavity 2 is provided with an inlet E1 enabling the intake of fluid.

This inlet E1 is equipped with an opening 22 located in the lower wall of the cavity 2, that is in the wall that is visible in FIG. 1, as this FIG. 1 is a bottom view.

At the opening 22 is located a non-return valve 21 in the form of a flexible tongue 21 attached to the lower wall of the cavity 2 at its end on the side opposite the opening 22, which allows the tongue 21 to alternately close the opening 22 or to leave it free when the air pushes on said tongue 21.

It can be observed that the compressible element 3 stops just before the opening 22 of the inlet E1, so as not to interfere with the opening of the valve 21.

The second cavity 5 is also provided with an inlet E2 enabling the intake of fluid, and exhibiting a structure similar to that of the inlet E1 of the first cavity 2. Thus there is also an opening in particular (which has not been labeled for the sake of clarity) and a non-return valve 24.

The area of the second cavity 5 including the inlet E2 is an extension of the principal portion of said second cavity 5, partially at the plantar arch.

Likewise, the area of the first cavity 2 including the inlet E1 is an extension of the principal portion of said first cavity 2, partially at the plantar arch.

Figure 4:
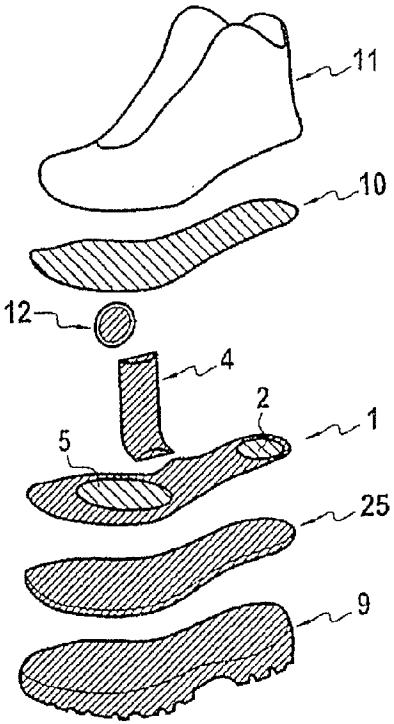
Figure 3:
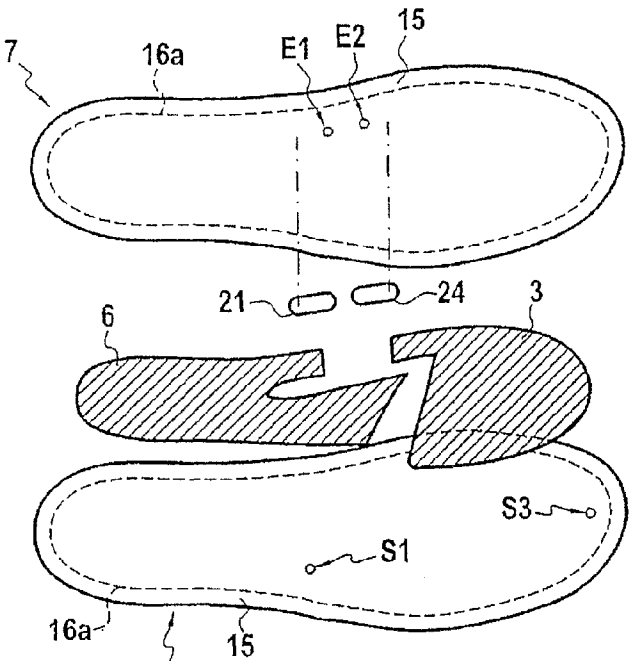

In this configuration, the two inlets E1 and E2, of the first cavity 2 and of the second cavity 5 respectively, are positioned at and at the edge of the area corresponding to the plantar arch, which is not a pressure area during walking, and near to one another, which makes it possible to supply them with fluid by the same means, without bothering the user as will be seen with reference to FIGS. 3 and 4.

Further, the inlets E1 and E2 extend substantially in the form of a duct, which makes it possible to channel the fluid to better propel it into the first and second cavities 2, 5 respectively.

In addition, the transition area from the first cavity 2 toward the second cavity 5, excluding the portion corresponding to the inlets E1 and E2, corresponds substantially to the forward portion of the mid-foot or medio-plantar area, that is an area within which the pressure exerted by the foot is not too great. This makes it possible to reduce the annoyance that these areas could cause during rocking of the foot due to thickness changes in these areas, which are more visible in the section view of FIG. 2 described later.

Furthermore, the first cavity 2 is equipped with an outlet S1 making it possible to exhaust the fluid toward the outside of said cavity 2.

This outlet S1 includes an opening 18 embodied in dotted lines, as it is positioned on the upper wall of the cavity 2 that is not visible in FIG. 1 which corresponds to a bottom view.

The compressible element 3 stops just before the area corresponding to the outlet S1, so as not to interfere with exhausting of the fluid.

Channels can be provided in this outlet S1 allowing the fluid to be better directed toward the opening 18, by creating obstacles 17, 19 constituting walls of the channels 20.

As will be seen hereafter, if the principal portion 1 is formed by assembly a lower wall and an upper wall, by welding for example, the obstacles 17, 19 can also be formed by welds 17, 19 of the upper wall to the lower wall.

Thus, even in the resting position, that is without deformation due to pressure on the structure, the upper wall and the lower wall, at the outlet S1, are touching, which creates a non-return effect preventing the fluid from entering from outside through said outlet S1.

The outlet S1 is of a generally substantially circular shape, and the obstacles or edges 17, 19 have substantially the shape of a circular arc and are centered on the opening 18 and arranged just between said opening 18 and the periphery of the outlet S1.

Regarding the second cavity 5, it is equipped with two adjacent outlets S2, S3 allowing exhausting of fluid toward the outside of said cavity 5.

These two outlets S2, S3 of the second cavity 5 exhibit a structure similar to that of the outlet S1 of the first cavity 2, and are therefore not described in detail.

These outlets S2, S3 are preferably positioned in the area corresponding to the toes, an area wherein it is particularly important that the user feel the fluid escaping through the outlets S2, S3.

However, these outlets S2, S3 must not be too near the edge 5*a* of the second cavity 5, so as to avoid too much crushing of the element 6 made of compressible and fluid-permeable material and to ensure optimal comfort for the user, even at the perimeter of the insole; the objective being that the user not perceive, in this case, the absence of foam.

Whether it is in the first cavity 2 or in the second cavity 5, the inlets are located behind the outlets.

Thus, the inlet E1 is positioned behind the outlet S1, that is to say that the distance separating said inlet E1 from the rear end of the first cavity 2 is less than the distance separating the outlet S1 from the rear end of said first cavity 2.

Likewise, the inlet E2 is positioned behind the outlets S2, S3, that is to say that the distance separating said inlet E2 from the rear end of the second cavity 5 is less than the distance separating the outlets S2, S3 from the rear end of said second cavity 5.

The inlet E1 in the first cavity 2 is, to be sure, located behind the outlet S1 as explained above, but nevertheless remains close to the outlet S1, in the forward portion of said first cavity 2.

At the inlet E1, the weld continues into the cavity so as to redirect the air toward the heel as the foot rocks, particularly when the pressure of the foot is exerted at the area corresponding to the outlet S1.

The channels 20 at the outlet S1 are substantially oriented from the back toward the front of the foot, in order to optimize the exhausting of air from the cavity 2 while the channels of the outlets S2 and S3 (not labeled for the sake of simplicity) are oriented perpendicularly to the channels 20 of the outlet S1 because the rocking of the foot has a circular motion at the front of the foot and consequently, for these outlets S2 and S3, optimization is relevant if the channels are in this direction.

Figure 2:
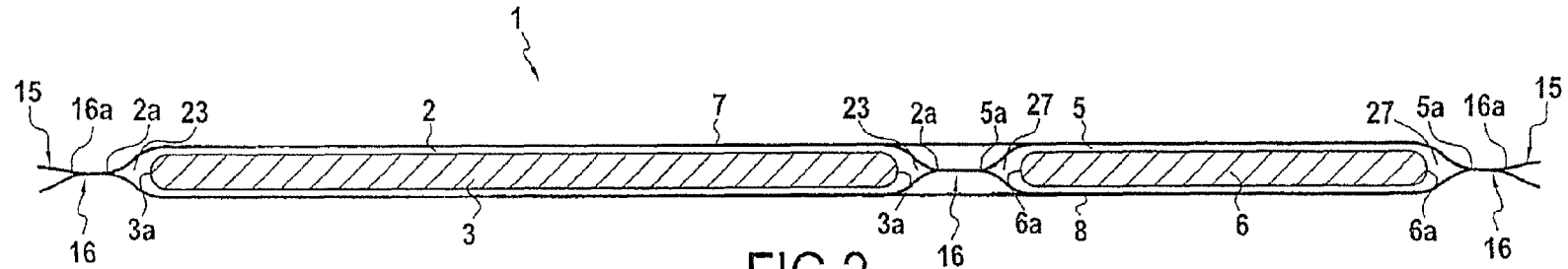

As will be seen more precisely with reference to FIGS. 2 and 3, the principal portion 1 is preferably constituted by an assembly of a lower wall and an upper wall.

Thus, thick assembly lines 16 are shown in FIG. 1 which correspond to assembly strips 16, areas wherein the upper wall and the lower wall join and are assembled.

Thus, the strip 16 between the lines 16*a* and 2*a*, between the lines 16*a* and 5*a*, as well as between the lines 2*a* and 5*a* at the transition between the cavities 2 and 5, forms the perimeter of the cavities 2, 5.

According to the exact geometric shape of the cavities 2 and 5, this assembly strip 16 can also be extended in a way that intrudes into the cavities, as is the case in FIG. 1 with the cavity 2, near the inlet E1.

The edges or obstacles 17, 19 presented above can also constitute small portions of the assembly area.

On the entire periphery of the principal portion 1, the material constituting the upper and lower walls continues into a perimeter strip 15, which facilitates the assembly of the insole into a shoe by sewing or stitching onto the upper of the shoe.

Possibly, this perimeter strip 15 can be provided with a weld bead or coverstitching line (not shown) which avoids said perimeter strip 15 buckling and facilitates the guiding and stitching or sewing onto the upper of the shoe during assembly.

Thus, with this example of an insole according to the invention, during rocking of the foot from the heel, air previously taken into the first cavity 2 through the inlet E1 is not expelled through the opening 22 of E1 thanks to the non-return valve 21, but is expelled gradually toward the outlet S1 and expelled by the opening 18 in S1, then fresh air brought in through the chimney(ies) is again taken into the first cavity 2 through the inlet E1 when the rocking of the foot continues and reaches the second cavity 5.

Likewise, when the rocking of the foot continues onto the second cavity 5, the air previously taken into said second cavity 5 through the inlet E2 is gradually expelled toward the outlets S2 and S3 and exhausted through the corresponding openings.

The peristaltic effect obtained is particularly satisfactory for the user's comfort when the width of the cavities 2 and 5 is less than or equal to the width of the footprint of the user.

The most optimal solution seems to correspond to a configuration wherein the width of the cavities 2 and 5 is equal to the width of the user's footprint.

As the foot rocks, the circulatory motion of the air occurs substantially in a straight line from the heel to the mid-foot area, then curves toward the end of the motion, at the front of the foot.

Also on FIG. 1 is embodied a section line CC, from which the corresponding section view in FIG. 2 is defined.

In this section view, the background details, that is behind the section line CC of FIG. 1, are not shown for the sake of clarity in FIG. 2.

Thus the principal portion 1 of the insole according to the invention in the embodiment of FIG. 1 is found in this FIG. 2, with the first and second cavities 2 and 5 having elements 3 and 6 respectively made of compressible fluid-permeable material, themselves defined by their ends 3*a* and 6*a*.

Between the edges 2*a* of the first cavity 2 and the edges 3*a* of the element 3 made of compressible, fluid-permeable material, a space 23 remains free to allow the upper wall 7 and the lower wall 8 to come together for assembly.

Likewise, between the edges 5*a* of the second cavity 5 and the edges 6*a* of the element 6 made of compressible, fluid-permeable material, a space 27 remains free to also allow the upper wall 7 and the lower wall 8 to come together for assembly.

Precisely, the main portion is made by assembling an upper wall 7 with a lower wall 8, preferably made of flexible material, for example of the polyurethane film type.

Assembly is performed by heat-sealing at assembly lines or strips 16 presented above with reference to FIG. 1.

In FIG. 2, these assembly lines 16 are located at the ends of the principal portion 1 (corresponding to the perimeter of the principal portion 1), and at the transition between the first and the second cavities 2, 5.

The first cavity 2 is defined by the edges 2*a* and the second cavity 5 is defined by the edges 5*a*.

Thus the assembly strip 16 at the ends of the principal portion 1 is defined by the boundaries or edges 2*a* and 16*a* on the one hand, and 5*a* and 16*a* on the other hand.

Moreover, the assembly strip at the transition between the first cavity 2 and the second cavity 5 is defined by the boundaries or edges 2*a* and 5*a*.

At the ends of the principal portion 1 viewed in section, therefore corresponding to the perimeter of the principal portion 1 as shown in FIG. 1, is located the strip 15 corresponding to an extension of the upper 7 and lower 8 walls beyond the assembly strips 16.

Thus the principal portion exhibits a constant thickness over its entire length and over its entire width, with the exception of the transition area between the first cavity 2 and the second cavity 5, and the perimeter of said first and second cavities 2, 5, consequently excepting the assembly strip 16, the spaces 23 and 27 and the perimeter strip 15.

The inlets E1, E2 and outlets S1, S2, S3 shown in FIG. 1 are not found in FIG. 2, considering the position of the section line CC in FIG. 1.

However, at the outlet areas S1, S2 and S3, and possible in certain embodiments, at the inlet areas E1, E2, the upper wall 7 and the lower wall 8 come together or are assembled, such that in said areas the thickness of the principal portion 1 is reduced.

Preferably, these areas of reduced thickness of the principal portion 1 are located in places where the pressure of the foot, when the foot rocks, is weak or even absent, such that the user does not feel this thickness reduction.

Likewise, the principal portion 1 exhibits a constant thickness with the exception of the perimeter of the first and second cavities 2 and 5 and with the possible exception of the inlets E1, E2 and/or of the outlets S1, S2, S3.

In FIG. 3 is shown an exploded view of the assembly of the principal portion 1 as shown above with reference to FIGS. 1 and 2.

For the sake of simplicity, only certain elements are shown and labeled.

Thus, the assembly of the upper wall 7 with the lower wall 8 at the assembly strips is shown again, for which only the lines 16*a* are shown, the assembly at the transition between the first and second cavities not being shown.

Beyond the assembly line 16*a*, there is also shown the perimeter strip 15 of the principal portion 1.

The first and second cavities 2 and S are not labeled. Only the elements made of compressible and fluid-permeable material 3 and 6 are shown.

Further, the inlets E1, E2 and the outlets S1, S3 are shown again, as are the non-return valves 21 and 24.

FIG. 4 shows schematically in exploded view a shoe incorporating the insole according to the invention.

The insole therefore exhibits the principal portion 1 inserted between the outsole 9, and possibly a layer 25, called the mid sole, whereon it can be glued for example, on the one hand, and an insole liner 10 on the other hand.

The representation of the principal portion 1 is simplified and leaves visible only the first cavity 2 and the second cavity 5 in a shape that has been intentionally simplified to a circle.

A chimney 4 is provided for channeling air toward the inlets E1, E2, not shown. Two distinct chimneys can be provided for the inlets E1, E2, or a single one as shown in FIG. 4.

Said chimney 4 is positioned along the upper 11 of the shoe, and connected at its end opposite to the inlets E1 and E2 to an opening 12 formed for example within the upper 11.

It can be provided that this opening 12 is equipped with a means of adjustment allowing the opening 12 to be opened or closed, or even to partially open it in various intermediate positions.

An exhaust channel (not shown) can also be provided for in similar fashion, connected to each outlet S1, S2, S3 (not shown).

If the principal portion 1 is provided with a perimeter strip 15 as explained previously with reference to FIGS. 1 through 3, it is possible to eliminate the mid sole 25 and to assemble the principal portion 1 directly by sewing the perimeter strip 15 onto the inside of the upper 11.

Furthermore, the insole liner 10 can be directly assembled onto the upper wall 7 of the principal portion 1.

Said insole liner 10, made of polyester for example, can in fact be assembled, particularly by heat-sealing, to the upper wall 7 of the principal portion 1.

One or more openings are then made in this layer 10 serving as an insole liner to allow exhausting of air from the openings of the outlets S1, S2, S3 formed in the upper wall 7.

It is possible for example to have an opening in the layer 10 facing each opening corresponding to the outlets S1, S2 and S3.

It is possible also to have several openings distributed in a circle around a point facing openings corresponding to the outlets S1, S2, S3.

The entire description above is given by way of example and does not limit the invention.

In particular, the exact shape of the cavities 2, 5, of the inlets E1, E2, of the outlets S1, S2, S3 and of the elements made of compressible and fluid-permeable material 3, 6, does not limit the invention.

Likewise, the exact number of cavities does not limit the invention. However, if the principal portion is provided with a single cavity 2, it will preferably be positioned so as to cover at least the area corresponding to the heel, or extend over the totality or quasi-totality of the principal portion 1.

In addition, the configuration having two cavities such as that presented in the examples above exhibits the advantage of optimizing the desired peristaltic effect both in climbing, where the front of the foot compresses the cavity 5, and in descending where only the back of the foot is mainly used.

The invention claimed is:

1. An insole for footwear, having a principal portion designed to accommodate the pressure of the foot of a user, said principal portion exhibiting an upper wall oriented toward the foot when in use and a lower wall oriented toward the side opposite said upper wall, said principal portion having at least a first deformable cavity filled at least partly with a compressible, fluid-permeable material, said first cavity being provided firstly with at least one inlet allowing intake of the fluid into said first cavity and secondly with at least one outlet, distinct from the inlet and allowing exhausting of the fluid from the first cavity, wherein the thickness of the principal portion, in the undeformed state of said first cavity is substantially constant at least between the portions of the principal portion in which said inlets and outlets are formed, and wherein the principal portion further includes at least a second deformable cavity, filled at least partly with a compressible, fluid-permeable material, said second cavity being provided firstly with at least one inlet allowing intake of the fluid into said second cavity, and secondly with at least one outlet distinct from inlet and allowing exhausting of the fluid from the second cavity, wherein the first and the second cavities do not communicate.

2. The insole according to claim 1, wherein the first cavity extends substantially over at least the rear portion of the principal portion.

3. The insole according to claim 2, wherein the first cavity extends from the portion of the principal portion corresponding to the heel, substantially to at least the boundary of the area of the principal portion corresponding to the medio-plantar area.

4. The insole according to claim 1, wherein the second cavity extends substantially at least over a front portion of the principal portion.

5. The insole according to claim 4, wherein the second cavity extends from the portion of the principal portion corresponding to the toes, substantially to at least the boundary of the area of the principal portion corresponding to the medio-plantar area.

6. The insole according to claim 5, wherein the first and second cavities extend at least partly over the area of the principal portion corresponding to the medio-plantar area.

7. The insole according to claim 1, wherein the distance between the inlet(s) of at least one of the cavities and the rear end of said at least one of the cavities is less than the distance between the outlet(s) of said at least one of the cavities and said rear end of said at least one of the cavities.

8. The insole according to claim 1, wherein at least one of the inlets includes an opening formed in said lower wall.

9. The insole according to claim 1, wherein at least one of the inlets is provided with a non-return valve.

10. The insole according to claim 1, wherein at least one of the outlets includes an opening and one or more channels defined at least in part by one or more edges.

11. The insole according to claim 1, wherein it includes a chimney connected to at least one of the inlets.

12. The insole according to claim 1, wherein it includes an exhaust channel connected to the at least one of the outlets.

13. The insole according to claim 1, wherein the compressible material is of the foam type.

14. The insole according to claim 1, wherein the upper wall is assembled with the lower wall at one or more assembly lines constituting the perimeter of at least one of the cavities.

15. The insole according to claim 1, wherein the upper wall and the lower wall are made of flexible plastic.

16. The insole according to claim 1, wherein the upper wall is covered with a layer serving as an insole liner, assembled with said upper wall and provided with one or more openings.

17. The insole according to claim 16, wherein the layer is provided with several openings distributed in a circle around the point facing at least one of the inlets and/or outlets.

18. The insole according to claim 14, wherein the upper and lower walls extend beyond the assembly line(s) so as to leave free a strip on the perimeter of the principal portion capable of allowing the assembly of said principal portion with the upper of an article of footwear.

19. The insole according to claim 18, wherein the perimeter strip is provided with a weld bead or a line of coverstitching.

20. The insole according to claim 1, wherein at least one of the cavities extends over a width of the principal portion, called the cavity width, such that the width of the user's footprint on said principal portion is greater than or equal to, preferably equal to said cavity width.

21. A footwear article equipped with an outsole, wherein it includes an insole according to claim 1 positioned above said outsole.

22. The footwear article according to claim 21, including an upper provided with an opening for taking in fluid connected to at least one of the inlets.

23. The footwear article according to claim 22, wherein the opening is adjustable between an open position allowing intake of the fluid and a closed position preventing intake of the fluid.

24. The footwear article according to claim 22, wherein the insole includes a chimney connected to at least one of the inlets, positioned along said upper and connected to the opening.

25. The insole according to claim 1, wherein said opening (s) face at least one of the inlets and/or outlets.

26. The insole according t claim 1, wherein at least one of the outlets includes and opening formed in said upper wall.

* * * * *